US006059469A

United States Patent [19]

Hirumi

[11] Patent Number: 6,059,469

[45] Date of Patent: May 9, 2000

[54] PRINTER DEVICE AND PRINTING METHOD

[75] Inventor: Yasushi Hirumi, Kanagawa, Japan

[73] Assignee: Sony Corporation, Tokyo, Japan

[21] Appl. No.: 09/065,665

[22] Filed: Apr. 23, 1998

[30] Foreign Application Priority Data

Jun. 25, 1997 [JP] Japan ..... 9-169102

[51] Int. Cl.[7] ..... B41J 35/28

[52] U.S. Cl. ..... 400/208; 400/247; 400/249

[58] Field of Search ..... 400/207, 208, 400/216.1, 224.2, 242, 245, 246, 249, 247; 347/214

[56] References Cited

U.S. PATENT DOCUMENTS

| | | | |
|---|---|---|---|
| 4,797,016 | 1/1989 | Lahr . | |
| 5,087,137 | 2/1992 | Burnard et al. | 400/249 |
| 5,185,315 | 2/1993 | Sparer . | |
| 5,289,210 | 2/1994 | Takayanagi | 400/175 |
| 5,366,307 | 11/1994 | McGourty et al. | 400/708 |
| 5,567,066 | 10/1996 | Paranjpe | 400/249 |
| 5,769,549 | 6/1998 | Kouzai et al. . | |
| 5,813,774 | 9/1998 | Sone et al. | 400/250 |
| 5,853,255 | 12/1998 | Soshi et al. . | |

FOREIGN PATENT DOCUMENTS 5-305727 11/1993 Japan .

*Primary Examiner*—John S. Hilten
*Assistant Examiner*—Anthony H. Nguyen
*Attorney, Agent, or Firm*—Philip M. Shaw, Jr.; Crosby, Heafey, Roach & May

[57] ABSTRACT

A printer device, and method, is disclosed which is used in conjunction with an ink ribbon assembly. The ink ribbon assembly includes an ink ribbon and a support. A storage device is integrated with the support. Data relating to the ink ribbon characteristics is stored in the storage device. The printer reads the data in the storage device and modifies the supplied print information ascending to the data stored in the ink ribbon assembly. Ink ribbon characteristic data can include production variance, ribbon type, and remaining ribbon data.

16 Claims, 17 Drawing Sheets

FIG. 9A
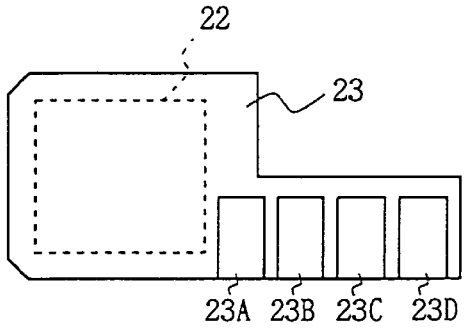
FIG. 9B
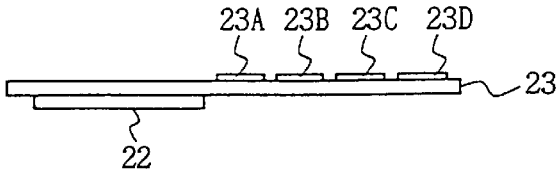
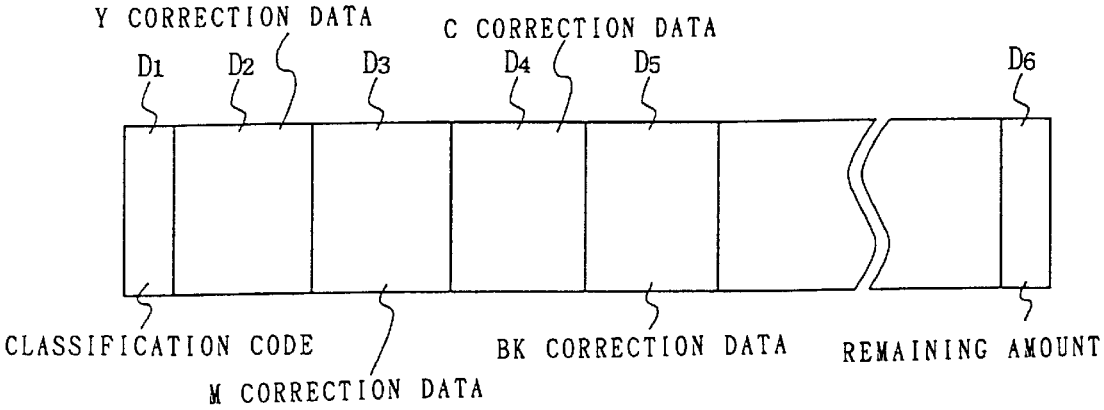
FIG. 10

| No. | TYPE | INK COLOR | SPECIAL FUNCTION | OPERATION OF PRINTER |
|---|---|---|---|---|
| 1 | SUBLIMATION | YMC | | TRICOLOR PRINTING IN SUBLIMATION MODE AND DISCHARGING OF PAPER |
| 2 | ↓ | YMC | LAMINATE | TRICOLOR PRINTING IN SUBLIMATION MODE THEN LAMINATE TRANSFERRING AND DISCHARGING PAPER |
| 3 | ↓ | YMCBk | | FOUR-COLOR PRINTING IN SUBLIMATION MODE AND DISCHARGING OF PAPER |
| 4 | FUSION | YMC | | TRICOLOR PRINTING IN FUSION MODE AND DISCHARGIG OF PAPER |
| 5 | ↓ | YMCBk | | FOUR-COLOR PRINGTING IN FUSION MODE AND DISCHARGING OF PAPER |

FIG. 18

PRINTER DEVICE AND PRINTING METHOD

BACKGROUND OF THE INVENTION

1. Field of the Invention

The present invention relates to a print system and method of printing for use, for example, in a thermal transfer printing.

2. Description of Related Art

Conventionally, a thermal transcription printer device prints characters, pictures, images, to and the like, based on supplied image data by thermal-transcribing ink. The ink may be a dye applied on one surface of an ink ribbon (hereinafter referred to as an ink side of the ribbon) and thereafter onto printing paper. Such a printer typically includes a device which directly applies transcription heat to the ribbon by using a thermal head, or which emits laser light onto a ribbon to generate transcription heat by light-to-heat conversion.

There are heat sublimating and heat fusing types of ink ribbons employed for such a thermal transcription printer as shown in FIG. 18, each of which is divided into a tricolor type comprising yellow (Y), magenta (M) and cyan (C), a four-color type comprising the above three colors and black (Bk), and so on, in accordance with the desired colors of ink.

As described above, there are many types of ink ribbons and printing conditions. For example, the driving voltage applied to a thermal head differs between the heat sublimating ink ribbon and the heat fusing ink ribbon, so that, in the case where a single printer device uses a plurality of types of ink ribbons, the operating mode of the printer device must be switched to a mode corresponding to the type or classification of ink ribbon to be used each time.

As shown in FIG. 19, a conventional ink ribbon assembly is shown having a ring 3 which is rotatably provided at one end of a supply spool 2 of an ink ribbon 1 and moreover, a classification code of the ink ribbon 1 is recorded on the peripheral surface of the ring 3 by a hot stamp in bar code. This classification code is read using an inexpensive reflex sensor at the printer device side to automatically switch the operating mode to the corresponding mode in accordance with the results read out.

In this technique, since the operating mode of the printer device is automatically switched to the corresponding mode in accordance with the ink ribbon used, mismatches between the operating mode of the printer device and the ink ribbon are generally prevented.

However, even in the case where ink ribbons are the same type, colors of ink are apt, in general, to change slightly with every production lot, so that the color balance and density of printed characters, pictures, and images may be slightly different even in the case of using ink ribbons of the same type.

Accordingly, to prevent such a change in the color balance, density and the like of printed images, data indicative of the production variances of individual ink colors of the ink ribbon to be used (hereinafter, referred to as production variance data) is initially given to a printer device or to a host computer connected to the printer device and image data supplied based on the production variance data is corrected (hereinafter, referred to as variance correction) to perform the printing.

In this case, as production variance data about individual colors of an ink ribbon assembly to be given to the printer device or the like is ascertained, the production variance of individual colors is digitalized and written on the surface of the packing case for the ink ribbon to allow a user to input these numerical values to the printer device in using the ink ribbon.

According to this method, however, it is necessary for the user to input the production variance data of individual colors to the printer when exchanging an ink ribbon, so that there is a problem of difficulty of use.

Additionally, in this method, if the input of the production variance data is lost or forgotten, the variance correcting processing is performed based on the preceding inputted production variance data, thus causing a problem in that the actual production variance of individual colors and the variance correcting processing of the printer are mismatched and the color balance, density or the like of printed images worsen because of the mismatched variance correcting processing. In addition, a similar problem occurs where the packing case for the ink ribbon is lost or missing.

In another conventional method for providing production variance data about individual colors of an ink ribbon to the printer, the production variance data is recorded, for example, on the peripheral surface of a ring 3 attached to the aforementioned supply spool 2 (FIG. 19) together with the classification code, by a hot stamp.

However, when using a hot stamp, it is difficult to secure sufficient recording capacity for the production variance data of individual colors to be recorded. Moreover, the case of compulsorily recording the production variance data of individual colors by using a hot stamp requires making hot-stamp blocks for every production of individual ink ribbons and of exchanging the blocks for every production lot, so that there is a problem in production efficiency.

Therefore, if the correction data for correcting the production variance of individual ink colors of ink ribbons can be given to the printer device without being inputted by the user and without using a hot stamp or the like, convenience of operation can be remarkably improved for the user and production efficiency can be improved.

SUMMARY OF INVENTION

In accordance with the present invention, data retention means for retaining correction data for correcting production variances of ink ribbons is integrated with an ink ribbon assembly. As a result, the necessity of the user inputting the correction data is saved by reading the correction data retained by the data retention means and correcting image data in accordance therewith.

The print system of the present invention is utilized with an ink ribbon assembly which has integrated with it retention or storage means for storing data relevant to the ink ribbon, such has production variance data. The print system reads out such correction data. The print system has correction means for correcting the image information in accordance with the correction data. As a result, a user doesn't have to manually input the correction data into a printer device.

Still further, the present invention employs a printing method comprising the steps of storing correction data relating to production variances of ink in an ink ribbon in a storage device associated with an ink ribbon support, reading the correction data from the data storage device to then correct the image information in accordance with the correction data, and printing the corrected print information. As a result, a user can save the labor of inputting the correction data to a printer device.

Storing necessary correction data relating to the ink ribbon in the storage device can save a user the labor of inputting the correction data to a printer device, thus allowing a printer to perform the corresponding corrections in order to print an image in accordance with the predetermined data.

Furthermore, with the present invention, the printer device comprises readout means for reading predetermined data from the storage means integrated with an ink ribbon for storing and retaining the predetermined data and correcting means for performing a predetermined correction in the image to be printed in accordance with the predetermined data.

In accordance with the invention, a method of printing is realized comprising the steps of storing predetermined data indicative of ink ribbon characteristics in a storage device associated with an ink ribbon support structure, reading the predetermined data from the storage device, modifying the supplied printing information in accordance with the predetermined data and printing an image in accordance with the modified printing information.

As a result, by storing the necessary data in the storage device, a user can save the labor of inputting the correction data to a printer device and can allow a printer to perform the corresponding correction to the color image in accordance with the predetermined data.

According to the present invention, data retention means is integrated with an ink ribbon assembly for retaining the correction data for correcting the production variation of ink provided in an ink ribbon. Desirably, such an arrangement is adopted on the printer device side so as to read the correction data from the data retention means, correct the image printing information in accordance with the read correction data and perform the printing in accordance with the corrected image printing information. In this way, the correction data is given to a printer device without a user's manual input and, thus, an ink ribbon, a printer device and a printing method, capable of markedly promoting the using convenience of a user, is implemented.

Additionally, according to the present invention, storage means integrated with a ribbon for storing and retaining predetermined data is provided in an ink ribbon assembly. With such an arrangement, a printer device reads the predetermined data from the storage means and executes the predetermined processing in accordance with the predetermined data. Thus, by storing the necessary data in the storage means, the printer device can automatically perform the corresponding processing in accordance with this data and, thus, markedly promoting the convenience of the printer.

BRIEF DESCRIPTION OF DRAWINGS

FIG. 9(*a*) is a top view and

FIG. 9(B) is a side view showing the configuration of a memory which is a part of the ink ribbon assembly of the present invention.

FIG. 10 is a figurative drawing showing the format of the various data related to the ink ribbon recorded in the memory of FIGS. 9(*a*)–9(B).

FIG. 18 is a chart illustrating types of ink ribbons.

DESCRIPTION OF PREFERRED EMBODIMENTS (1) γ Correcting Processing and Variance Correcting Processing A heat transcription type printer device expresses half tones for each pixel by controlling the application energy to be applied to a heater of a thermal head so as to change the amount of ink for the heat transcription onto a printing paper in accordance with the shade of image to be printed.

There are several methods of controlling the application energy to the heater of the thermal head. By a first method the time of sending an electric current to the heater is kept constant to allow a value of voltage to change. By a second method the value of voltage applied to a heater is kept constant to allow the time period of sending an electric current to change.

In the printer device using the second method, there is a widely employed technique of driving the thermal head in accordance with the image data which is obtained from the pulse width modulation of image data for each color representing the gradation of individual pixels in predetermined bits (e.g., 8 bits in the case of the 256 gradation) in a pulse width modulation (PWM) circuit.

Figure 1:
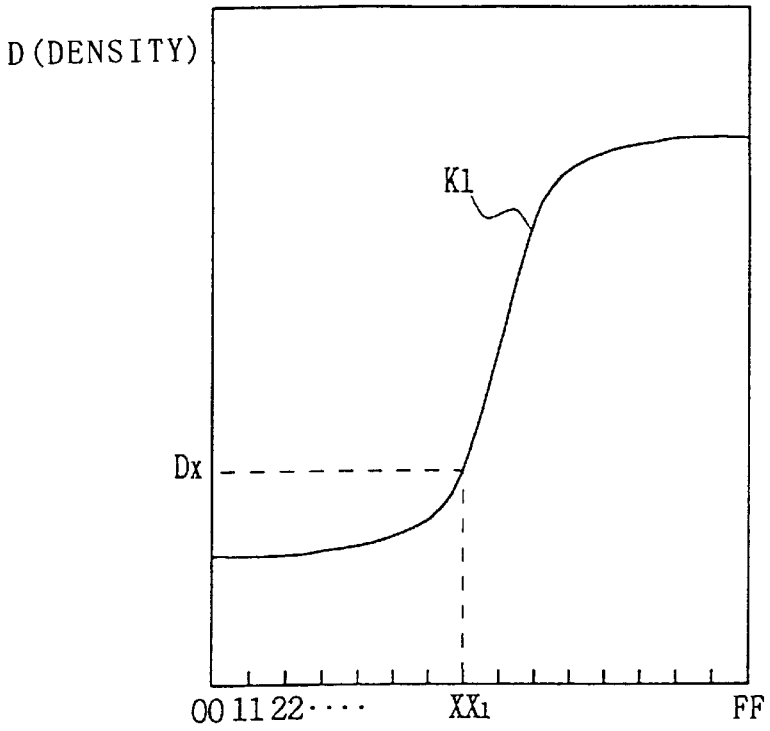
FIG. 1 is a graph of a characteristic curve explaining the relation between a values of image data and the density of a printed image.

In this case, the relation between a value of image data given to the PWM modulation circuit at the time of the transcription of a certain color by heating and the characteristics of density of a printed image (dynamic coloring characteristics) can be expressed in a curve (hereinafter, referred to as dynamic coloring characteristic curve) K1 as shown in FIG. 1. This dynamic coloring characteristic curve K1 depends on the ink ribbon and the printing paper, so that a different curve is depicted with ink of another color. Incidentally, in FIG. 1, the shades of images are selected so as to be expressed in terms of 256 grades. The density of printed images and values ("00"to "FF") of image data supplied to the PWM modulation circuit are taken in the axis of ordinates and the axis of abscissas, respectively.

For example, if image data sent to the printer device from an external source such as a personal computer are pulse-width-modulated in the PWM modulation circuit, uncorrected, and printing is performed in accordance with the obtained data, the printed result greatly differs in the expression of contrast and half tone from the image seen on a screen. This is because the dynamic coloring characteristics of each ink ribbon differs from the γ characteristics of a monitor.

Figure 2:
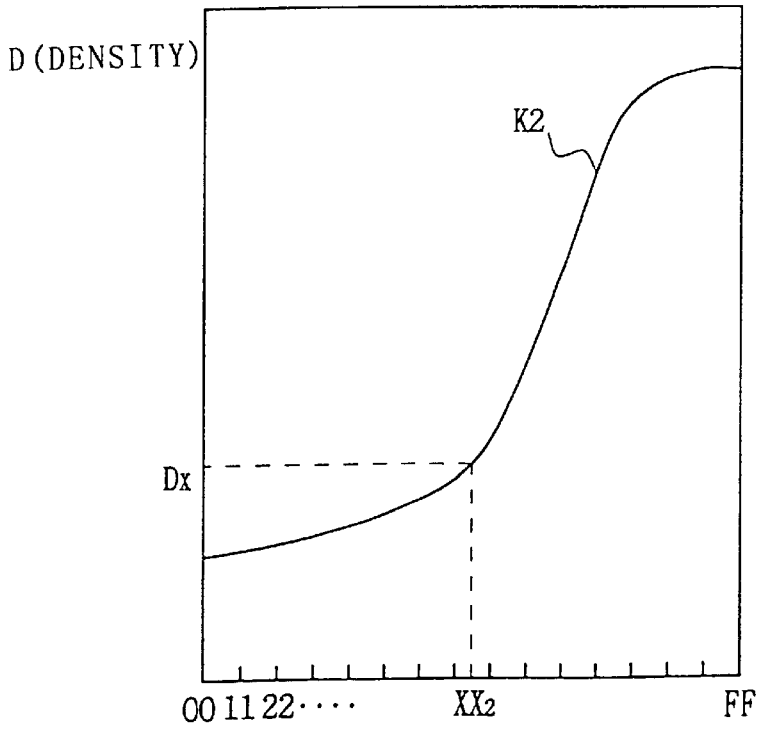
FIG. 2 is a graph of a characteristic curve showing an ideal density curve viewed from a monitor.

It is desired that data supplied to the printer device correspond to that observed of an image on a monitor when represented in accordance with an ideal dynamic coloring characteristic curve K2 shown in FIG. 2. However, in order for image data to be provided to the printer device so as to be printed in accordance with this dynamic coloring characteristic curve K2, it is required to correct the image data supplied to the printer device, prior to providing it to the thermal head, as represented by the dynamic coloring characteristic curve K2 shown in FIG. 2.

When a value of the image data supplied to the printer device is $XX_2$ (FIG. 2), such a correction can be performed by providing the data value $XX_1$ (FIG.1) corresponding to the dynamic coloring characteristic curve K2 of the ink to the thermal head so that the same density Dx is obtained.

Figure 3:
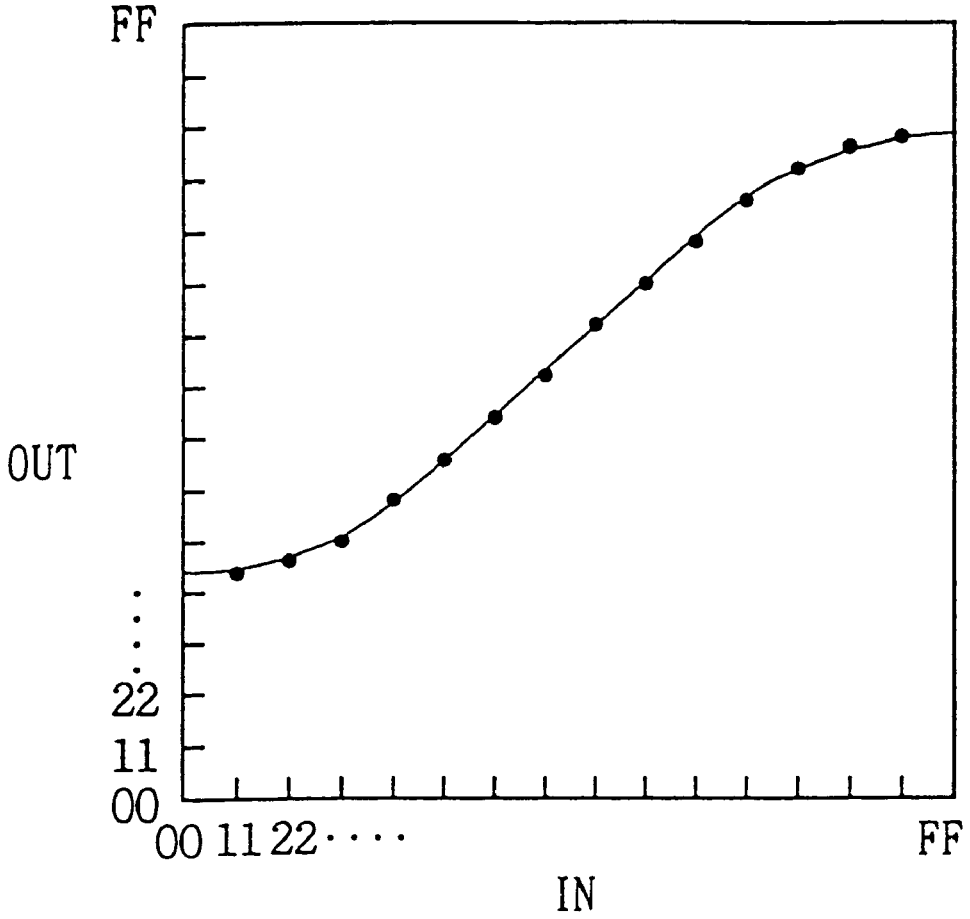
FIG. 3 is a graph of a characteristic curve illustrating γ correction data.

From FIGS. 1 and 2, for example, values of data (the axis of abscissas in FIG. 1) according to the dynamic coloring characteristics of the ink having the same value of density for individual data values (the axis of abscissas in FIG., 2) of image data are measured in advance to prepare correction data (hereinafter, referred to as γ correction data) as shown in FIG. 3 and a correction circuit (hereinafter, referred to as γ correction circuit) for converting the data value of the supplied image data into the data value according to the dynamic coloring characteristics of the ink which is actually disposed at the front stage of the thermal head, so that a mismatch in the printed result due to the difference between the dynamic coloring characteristics of individual ink ribbons and the γ characteristics of the monitor as described above can be avoided. Since the dynamic coloring characteristic curve K2 changes depending on the temperature, the γ correction data to be used is changed in accordance with the temperature of the thermal head.

However, even if such a γ correcting processing is performed, varied dynamic coloring characteristics of each color in an ink ribbon with individual production lots leads to a disturbance in color balance and a change in density each time an exchange of ink ribbons takes place, thereby requiring further correction.

Therefore, correction data for correcting production variances of each color of an ink ribbon (hereinafter, referred to as variance correction data) is created in advance and if correction is made so as to cancel the production variances in accordance with the variance correction data, a disturbance in color balance and a change in density due to the production variances can be avoided.

Figure 4:
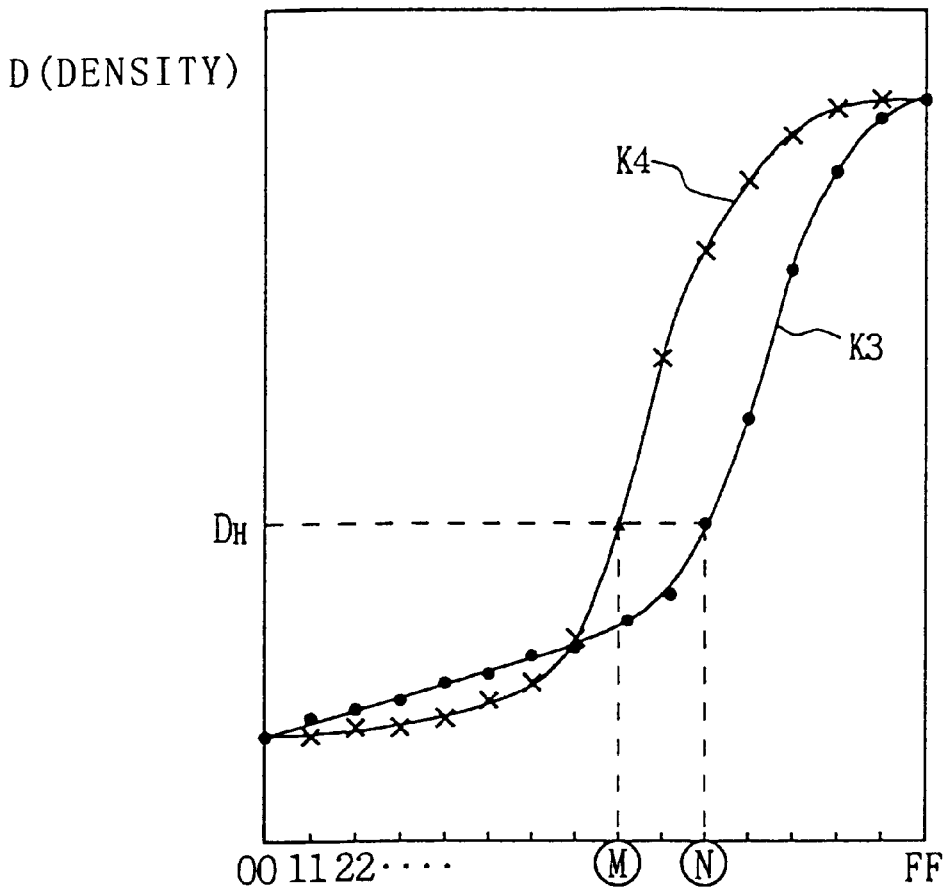
FIG. 4 is a graph of a characteristic curve showing the respective densities in a reference lot and a variance correction created lot.

Accordingly, γ correction data capable of obtaining a density curve (i.e., dynamic coloring characteristic curve K2 in FIG. 2) for a target in the image print using the ink ribbon of a lot serving as a reference (hereinafter, referred to as a reference lot) is first made and stored in a γ correction circuit. FIG. 4 shows a curve K3 interpolated based on the respective density values to be printed when data of "00", "11", "22", "33", "44", "55", "66", "77", "88", "99", "AA", "BB", "CC", "DD", "EE" and "FF" in hexadecimal digits are inputted in the γ correction circuit, which data points are designated with dots, e.g., "●".

Next, when the data for 16 points from "00" to "FF" is inputted to the γ correction circuit and a print is made using the ink ribbon of a different lot serving as the production target of variance correction data (hereinafter, referred to as variance correction data creating lot), the respective printed values of printed density are individually detected. In this case, FIG. 4 shows a curve K4 represented by "X" which is obtained by interpolating these respective values of density. The difference between these two curves K3 and K4 originates from a difference in the dynamic coloring characteristics of ink. From these two curves K3 and K4, the density $D_H$ corresponding to the data value N obtained when using the ink ribbon of a reference lot is obtained for the data value M when using the ink ribbon of the variance correction data created lot.

Figure 5:
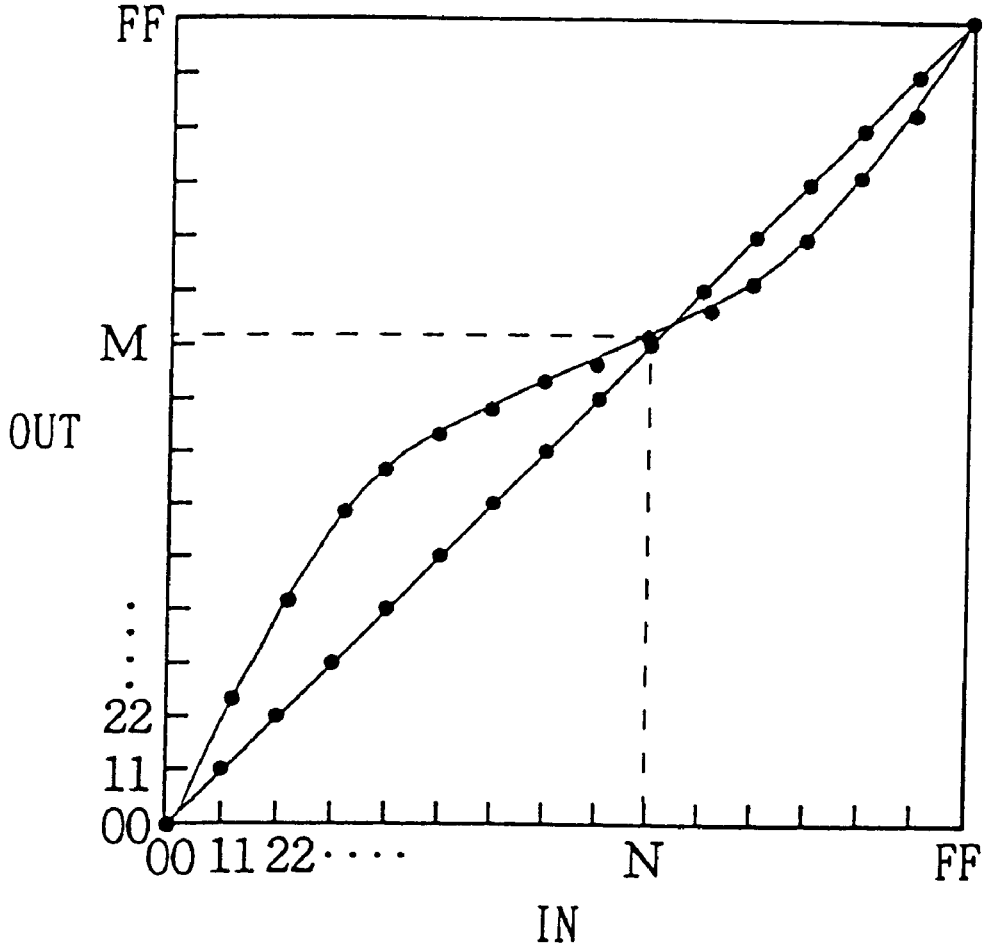
FIG. 5 is a graph of a characteristic curve illustrating variance correction data.

In a manner similar to this, when data values from "00" to "FF" are inputted to the γ correction circuit, the data values when using an ink ribbon of the variance correction data created lot for obtaining the same density value as with ink ribbons of the reference lot are successively detected. Variance correction data for the relevant color for an ink ribbon of the variance correction data created lot shown in FIG. 5 is created. Incidentally, if an ink ribbon of the reference lot and ink of an ink ribbon of the variance correction data created lot have the same dynamic coloring characteristics, the variance correction data corresponding to the data values "00" to "FF" of image data lie on a straight line as shown in FIG. 5.

Thus, by subjecting the image data to be supplied to a printer device to the γ correcting processing described above and such variance correcting processing, occurrence of a differences in color balance and density between an image displayed on a monitor and a printed image can be prevented.

(2) One Embodiment of a Print System According to the Invention

Figure 6:
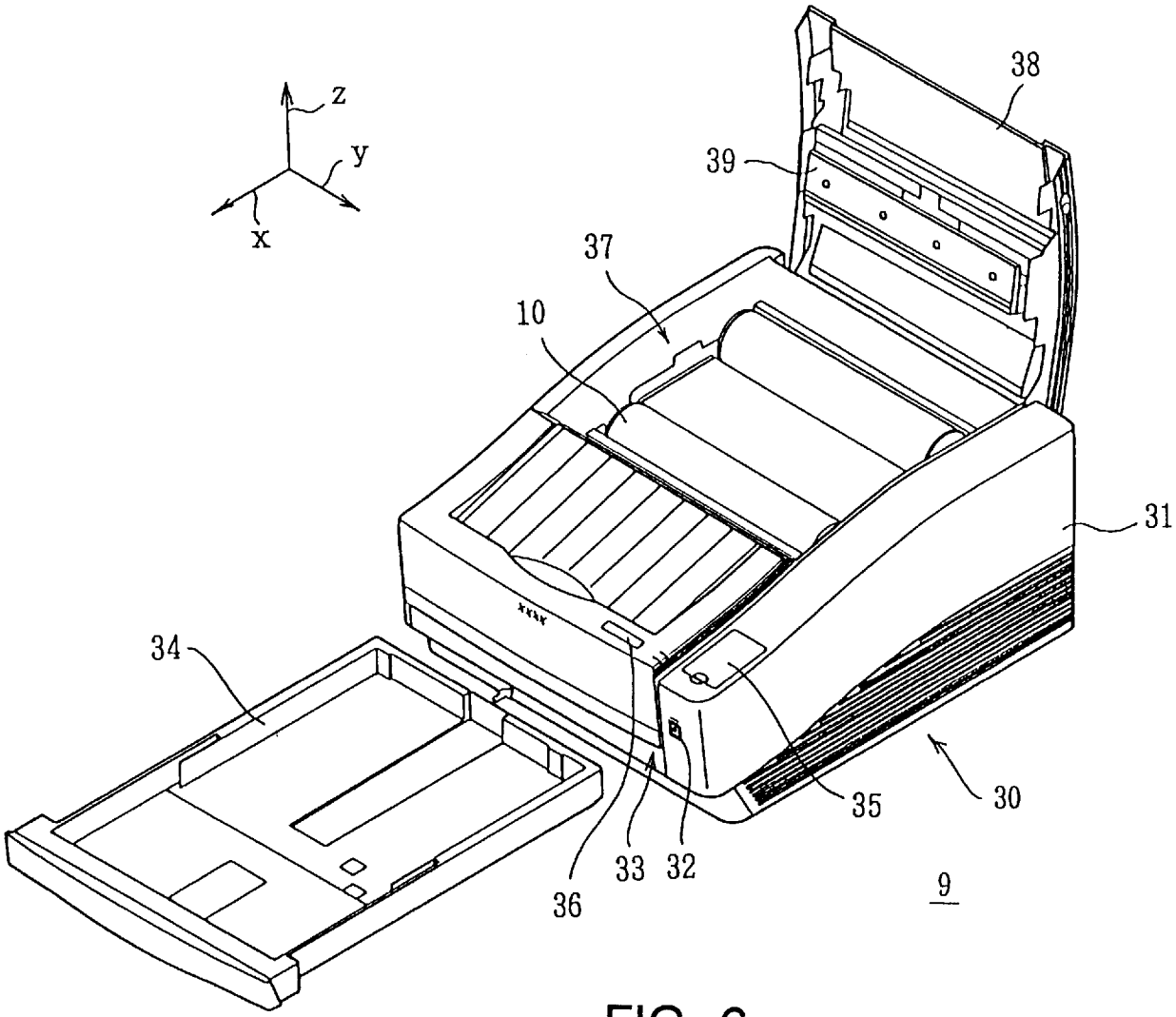
FIG. 6 is a perspective view showing the configuration of a printer according to the present embodiment.

FIG. 6 shows a print system 9 comprising an ink ribbon assembly 10 and a printer device 30 according to the present invention.

Figure 7A:
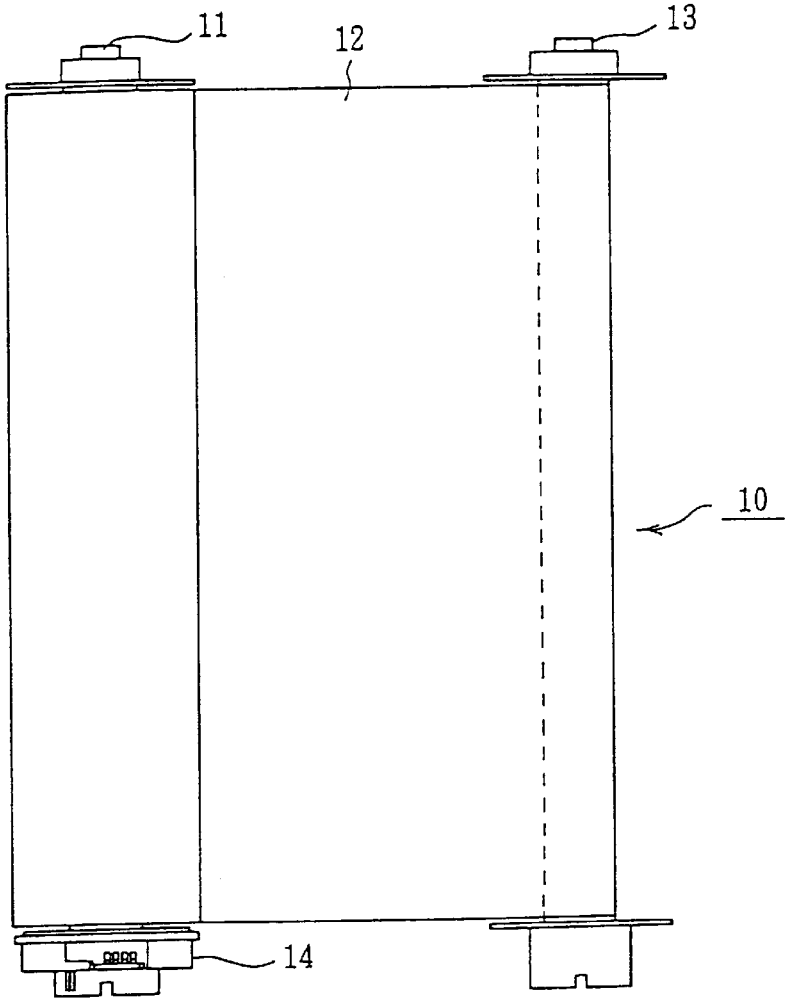
FIG. 7(*a*) is a top view.
FIG. 7(B) is a side view showing the configuration of an ink ribbon assembly in accordance with the present invention.
Figure 7B:
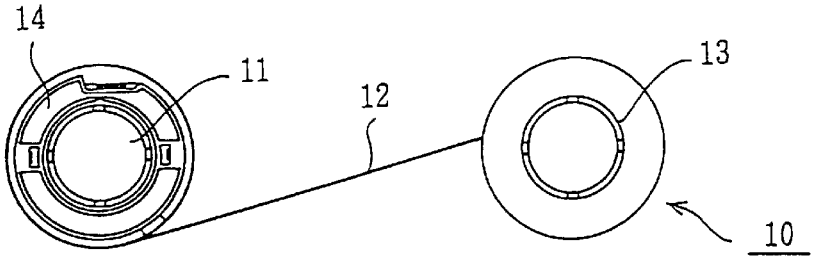

As shown in FIGS. 7(*a*) and 7(B), in the ink ribbon assembly 10, a belt-shaped ribbon 12 is wrapped around, and supported by, a supply spool 11 and moreover, one end of the ribbon 11, in a longitudinal direction, is fixed at a take-up spool 13. Additionally, a lot correction ring 14 is rotatably attached to one end of the supply spool 11 in a longitudinal direction.

Figure 8A:
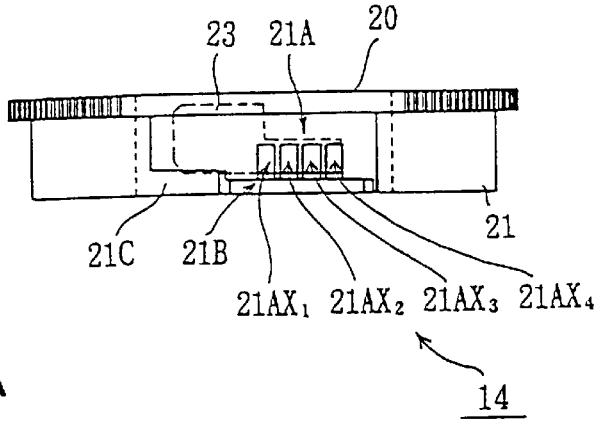
FIG. 8(*a*) is a top view.
FIG. 8(B) is a front view.
FIG. 8(C) is a side view showing greater details of the correction ring of the ink ribbon assembly of FIGS. 7(*a*)–7(B).
Figure 8B:
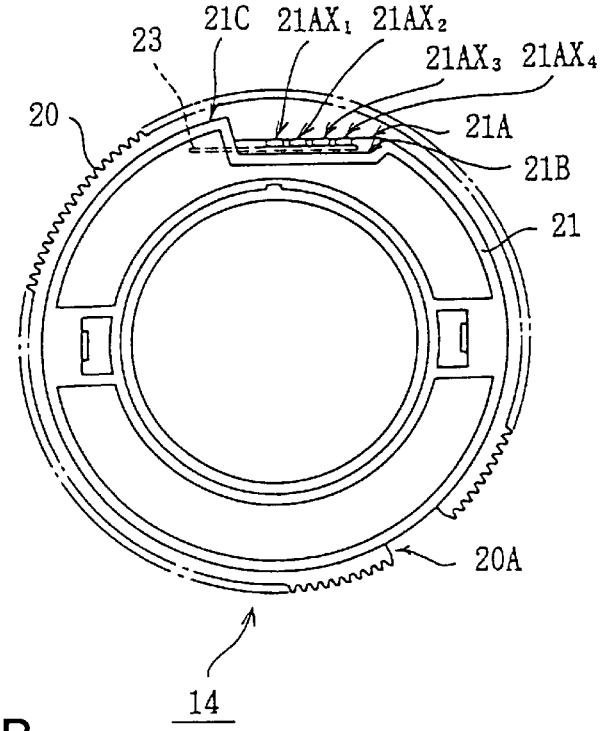
Figure 8C:
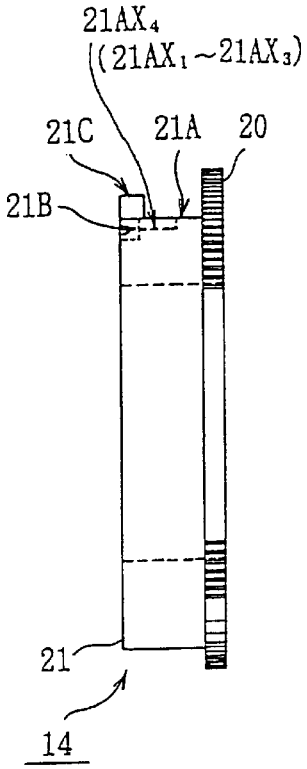

As shown in FIGS. 8(*a*) to 8(C), the lot correction ring 14 comprises a ring-shaped gear part 20 and a cylinder part 21 which is slightly smaller in outside diameter than and equal in inside diameter to the gear part 20. The gear part 20 is provided coaxially on one surface of the cylinder part 21.

On the periphery of the cylinder part 21, a flat part 21A is provided in a direction perpendicular to the radial direction of the cylinder part 21. A memory substrate 23 mounting a nonvolatile memory 22, as shown in FIGS. 9(*a*) and 9(B), is disposed on the inner side of the flat part 21A.

As shown in FIGS. 8(*a*) to 8(C), a plurality of openings 21AX1 to 21AX4 are provided on the flat part 21A corresponding respectively to a plurality of individual electrodes 23A to 23D formed on one surface side of the memory substrate 23 so that these corresponding electrodes 23A to 23D are exposed to the outside.

Furthermore, as shown in FIG. 10, classification code data D, representing the classification code of the ink ribbon, variance correction data $D_2$ to $D_5$ of individual colors of ink created as mentioned above, remaining amount data $D_6$ representing the remaining amount of the ribbon 12, and the like, are written in the memory 22. Readout of memory 22 takes place via individual electrodes 23A to 23D of the memory substrate 23.

In this embodiment, the conversion values of image data concerning the 16 points of "00" to "FF" (values of individual "●" in the axis of abscissas in FIG. 5) are stored in the nonvolatile memory 22 as the variance correction data $D_2$ to $D_5$ of individual ink colors of an ink ribbon 10.

As seen in FIG. 6, the printer device 30 includes a power switch 32 and a paper feed tray insert port 33 which are provided in the front of case 31 and are so arranged that printing paper can be set to a predetermined condition by putting the printing paper in the paper feed tray 34 and setting the tray inside the case 31 via the paper feed tray insert port 33.

At the top front end of the case 31, a slide door 35 is openably disposed so as to cover a control panel, which is not shown, and is disposed inside the case 31. Moreover, a display window 36 is disposed so as to expose the display surface of a liquid crystal panel which is not shown and is disposed inside the case 31 to the outside. Thus, this printer device 30 is so arranged that the opening of the display door 35 allows various operational switches provided on the control panel to be operated and that various messages displayed on the liquid crystal panel are visible through the display window 36.

At the rear of the case 31, an ink ribbon setting section 37 is provided and moreover a top cover 38 is provided so as to cover it. The ink ribbon 10 is loaded inside the case 31 by closing the top cover 38 after putting the ink ribbon 10 to a predetermined condition in the ink ribbon setting section 37.

A line-type thermal head 39 is installed inside the top cover 38. By closing the top cover 38 after putting the ink ribbon 10 in the ink ribbon setting section 37, the thermal head 39 is pushed against a ribbon 12 of the ink ribbon assembly 10.

Figure 11:
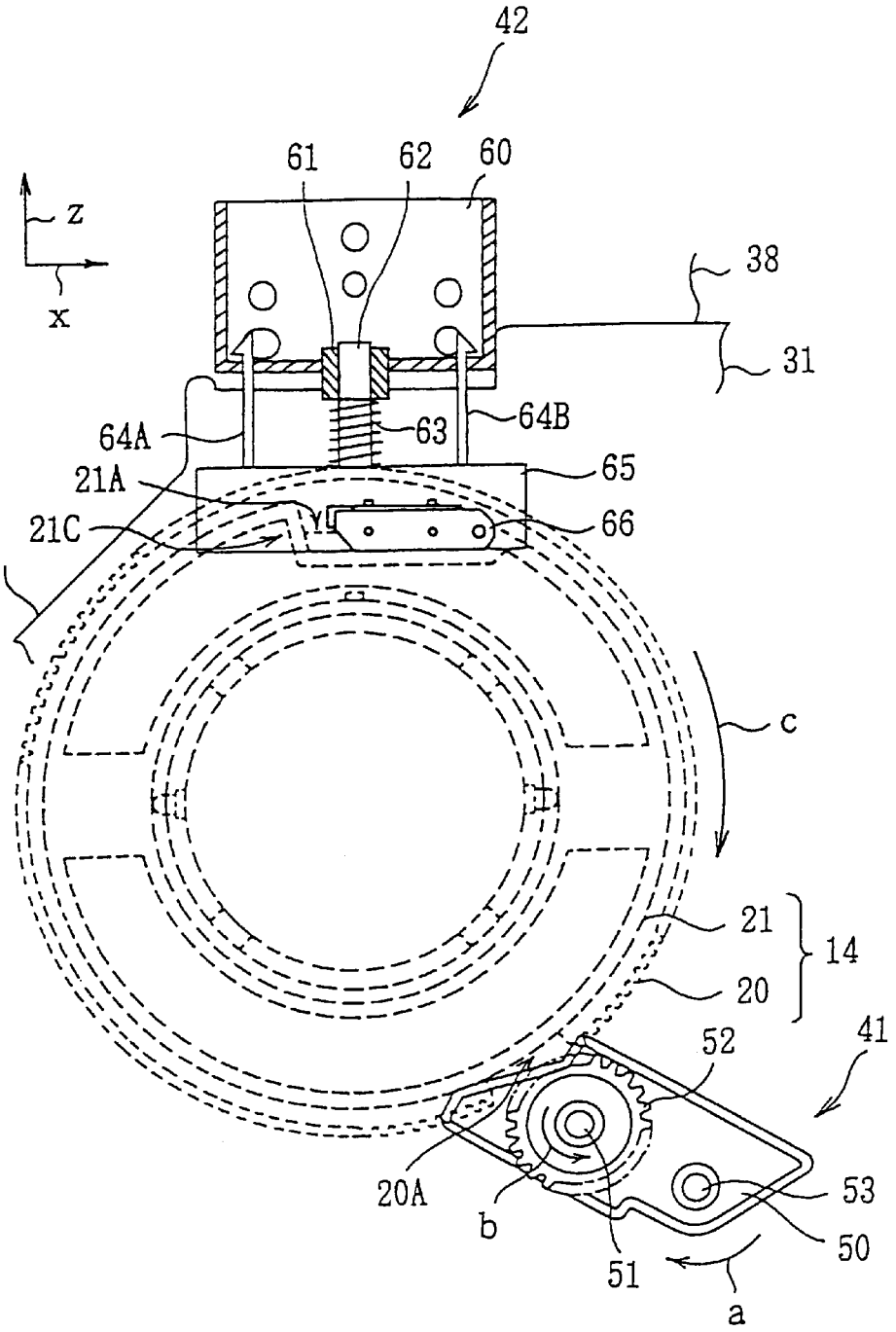
FIG. 11 is a front view showing the rotational driving section and sensor section in a printer device in accordance with the invention.

Printer device 30, as shown in FIG. 11, includes a rotational driving section 41 which engages a lot correction ring 14 of the loaded ink ribbon assembly 10 inside the case 31. Moreover, a sensor section 42 is provided in association with the lot correction ring 14 inside the top cover 58.

The rotational driving section 41 has a gear 52 rotatably attached to a movable plate 50 around shaft 51, and the disposed position is selected so that the gear 52 is engaged with the gear part 20 of the lot correction ring 14 of the ink ribbon 12 loaded in the ink ribbon setting section 37.

Movable plate 50 is pivotally attached to the shaft 53 fixedly provided inside the case so as to rotate or pivot over a slight angle in the direction of the arrow "a" from the position shown in FIG. 11 by a stopper which is urged by means such as spring (not shown).

In the rotational driving section 41, the gear 52 is urged against the gear part 20 of the lot correction ring 14 when the ink ribbon assembly 10 is loaded in the ink ribbon setting section 37, thereby enabling the gear 51 to engage the gear part 20 of the lot correction ring 14 of the ink ribbon 10.

In the rotational driving section 41, a rotational force in the direction of the arrow "b" is exerted on to the gear 52 via a rotational force transmission system from a motor (not shown), thus enabling the lot correction ring 14 of the ink ribbon assembly 10 loaded in the case 31 to be rotated in the direction of the arrow "c" in accordance with this rotational force.

Figure 12:
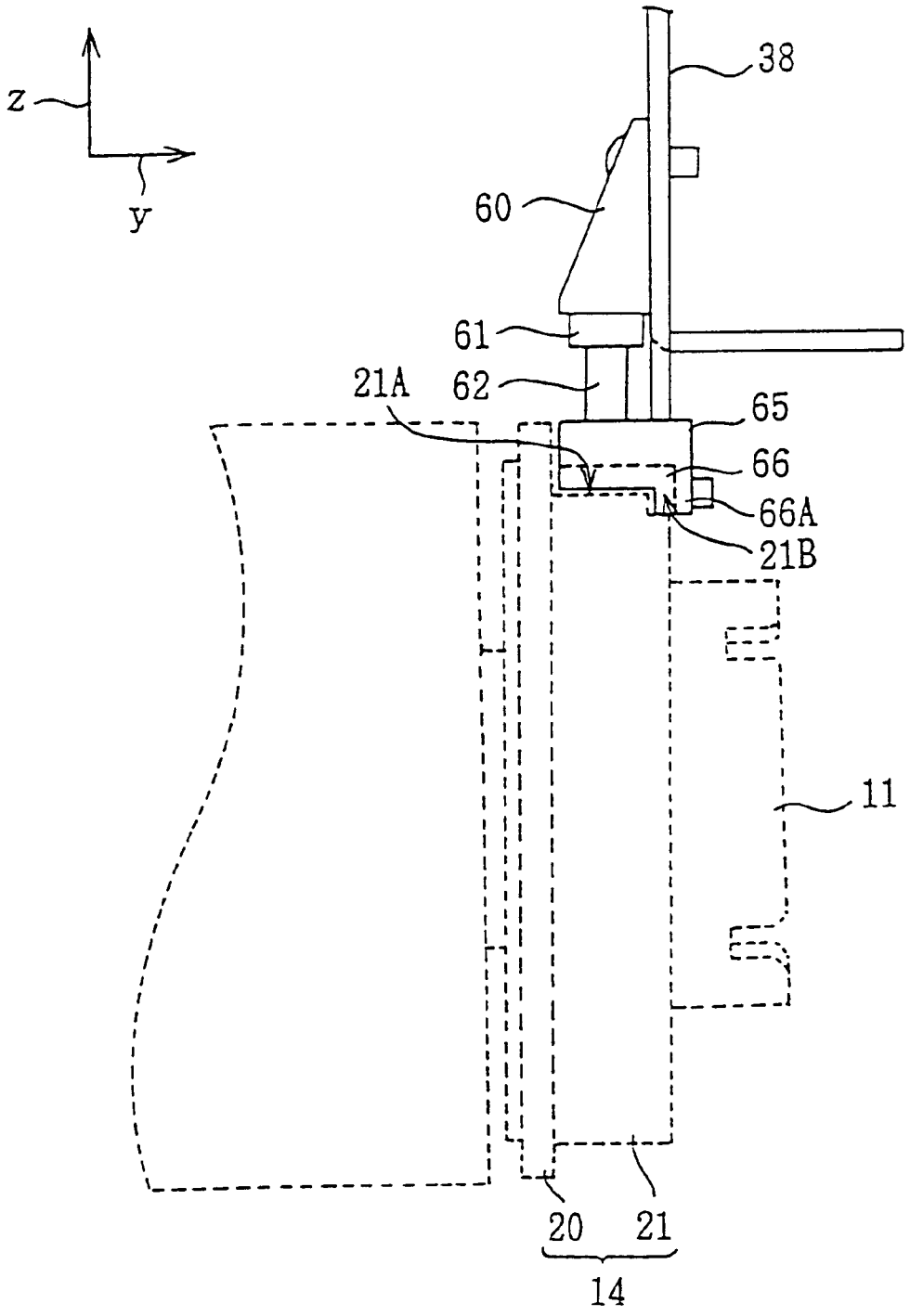
FIG. 12 is a side view showing the sensor section of FIG. 11.

As shown in FIGS. 11 and 12, the sensor section 42 has a fixed part 60 fixed to the internal surface of the top cover 38 by a screw. A shaft body 62 is attached to the fixed part 60 via a bearing 61 so as to be slidable in the Z direction.

A sensor retaining section 65 is attached so as to be urged by a coil spring 63 downward, restricted in movement range by stoppers 64A and 64B.

A sensor 66 is attached to the lower end of the sensor retaining section 65, so that the sensor 66 can be pushed against the peripheral surface of the cylinder part 21 of the lot correction ring 14 of the ink ribbon 10 by the resiliency of the coil spring 63, when the top cover 38 is closed after an ink ribbon 10 is loaded in the ink ribbon setting section 37.

Figure 13A:
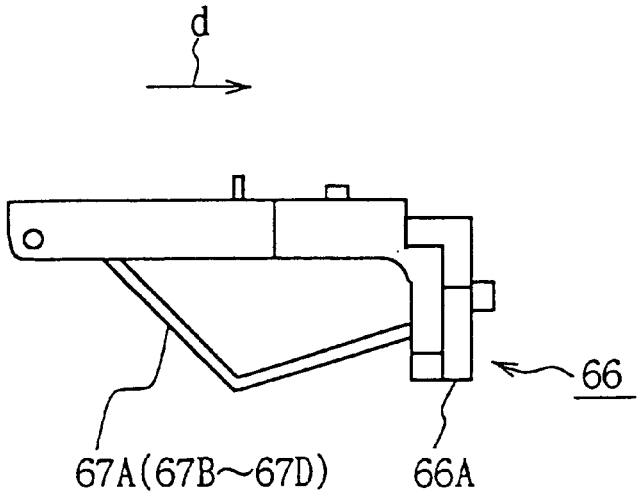
FIG. 13(*a*) is a side view.
FIG. 13(B) is a bottom view showing the configuration of the sensor of FIG. 11.

A plurality of contacts 67A to 67D made of spring members protruding downwardly are provided on the lower surface side of sensor 66, as shown in FIGS. 13(*a*) and 13(B). The contacts are aligned with and correspond with the individual openings 21AX1 to 21AX4 (FIGS. 8(*a*) to 8(C)) bored in the flat part 21A of the cylindrical part 21 of the lot correction ring 14.

Provided on the lower surface side of this sensor 66, is a protuberant part 66A provided at the outer part (the part facing the outer part of the peripheral face of the cylindrical part 21 of the lot correction ring 14) shown by the arrow "d" in FIG. 13(*a*) so as to protrude slightly lower than all contacts 67A to 67D. Furthermore, as shown in FIGS. 8(*a*) to 8(C), in the lot correction ring 14 of the ink ribbon 10, a concave part 21B is provided corresponding to the protuberant part 66A of the sensor 66 outside the flat part 21A.

Figure 13B:
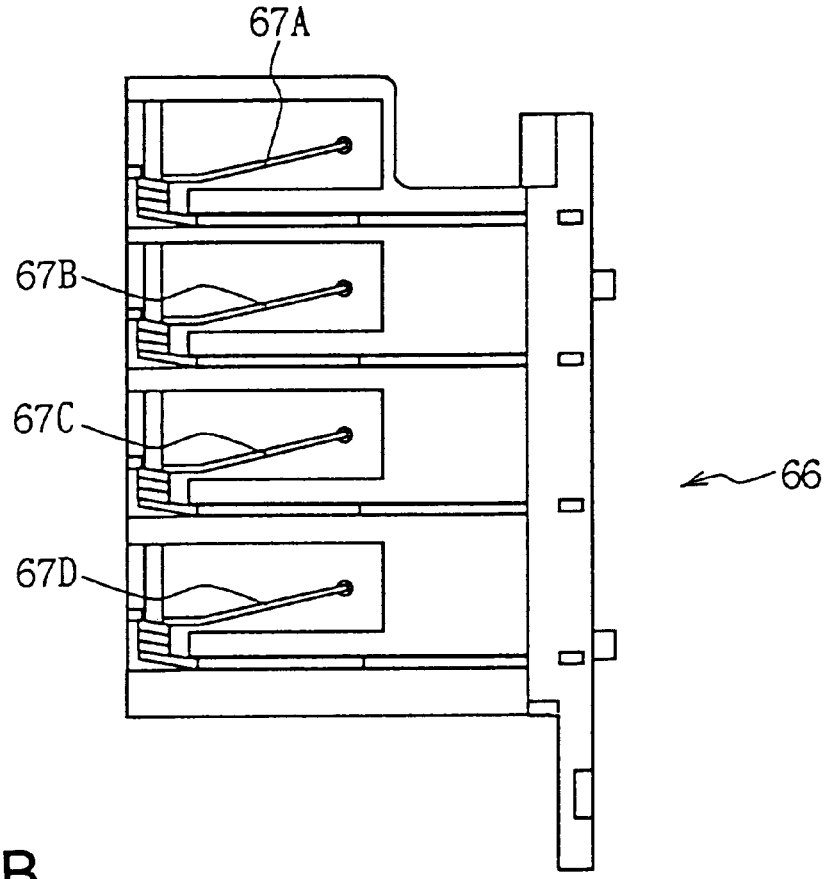
Figure 14A:
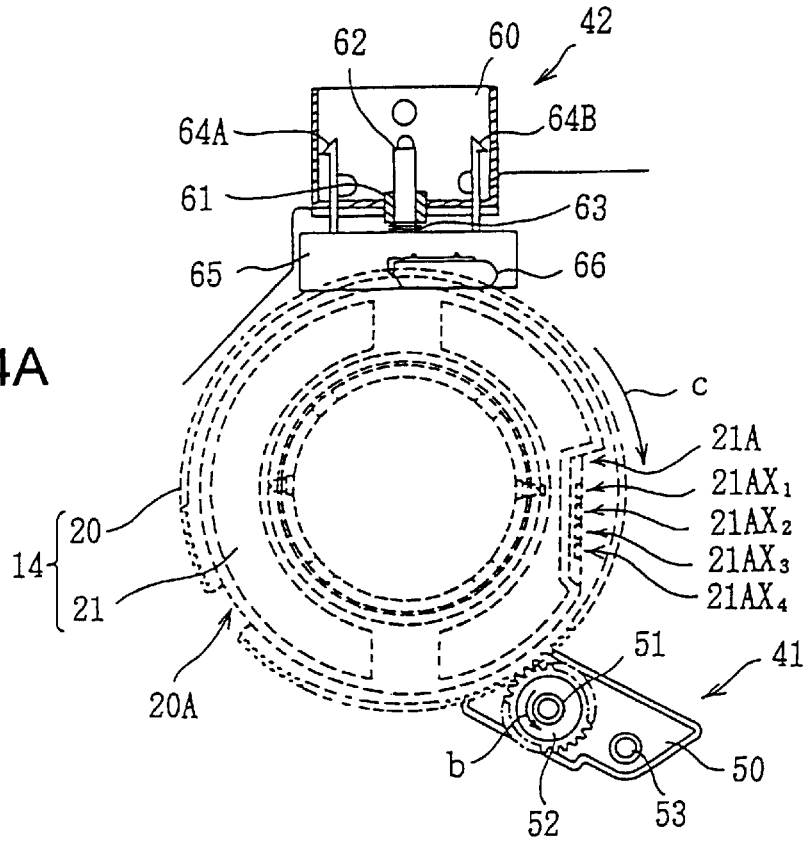
FIGS. 14(*a*) and 14(B) are front views illustrating the rotational operation of the correction ring in first and second positions.

If the flat part 21A is not positioned directly below the sensor 66 as shown in FIG. 14(*a*) in a state where the top cover 38 is closed after the ink ribbon assembly 12 is loaded in the ink ribbon setting section 37, the front end surface of the protuberant part 66A of the sensor 66 touches the peripheral surface of the cylindrical part 21 of the lot correction ring 14, thereby preventing individual contacts 67A to 67D, FIG. 13(B), of the sensor 66 from touching the peripheral surface of the cylindrical part 21.

Figure 14B:
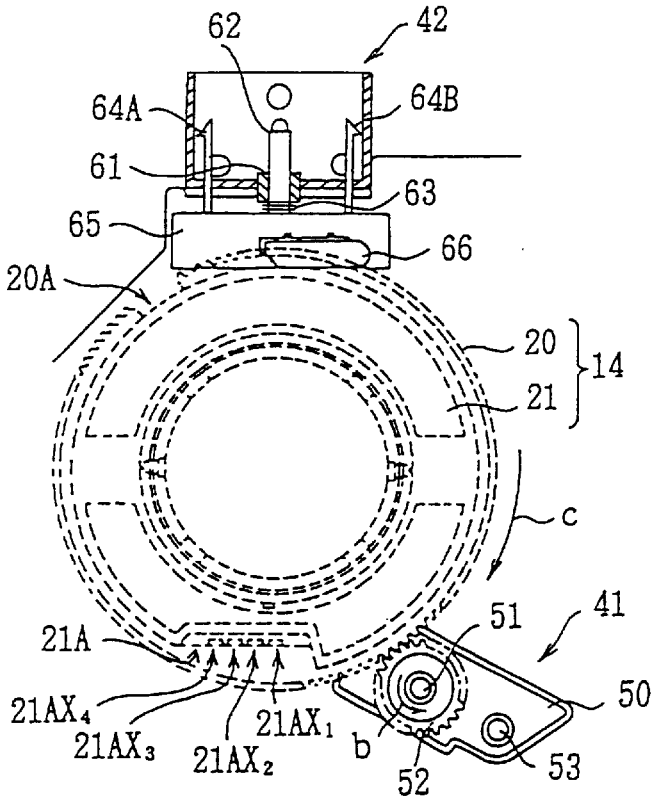
Figure 15A:
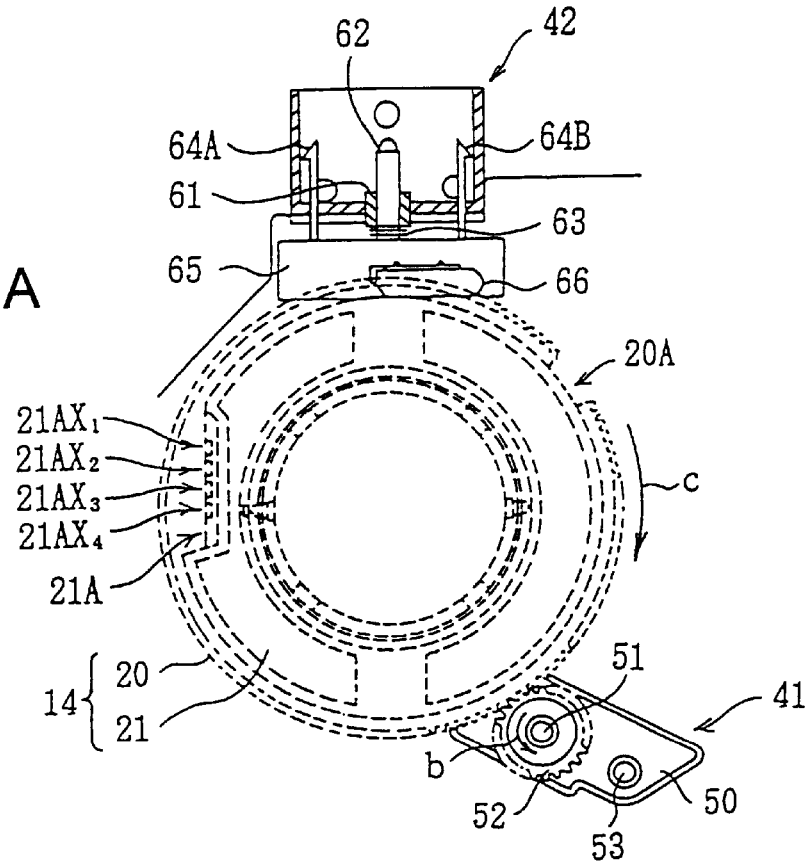
FIGS. 15(*a*) and 15(B) are front views illustrating the rotational operation of the correction ring according to the invention in third and fourth positions.
Figure 15B:
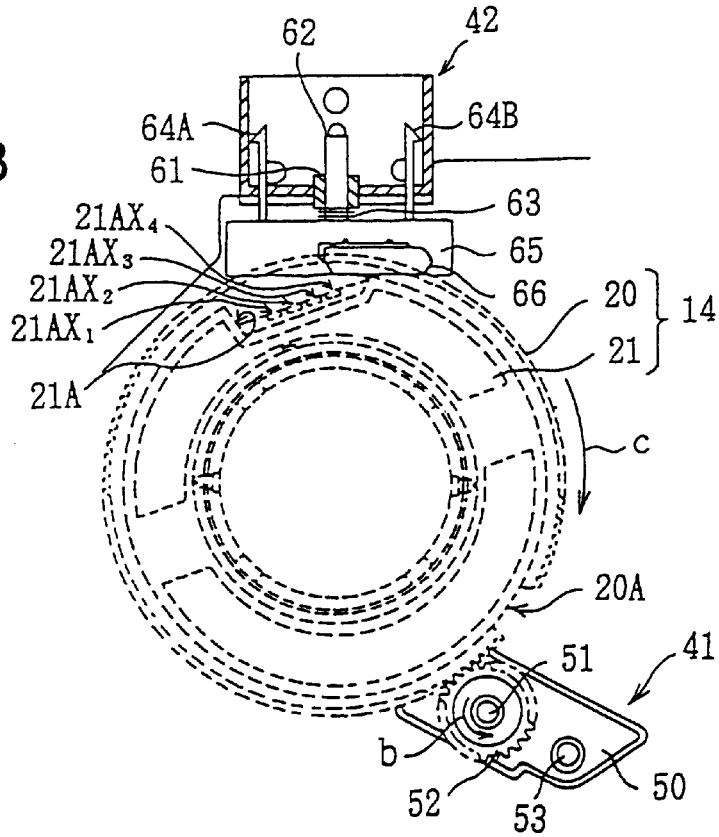
Figure 16A:
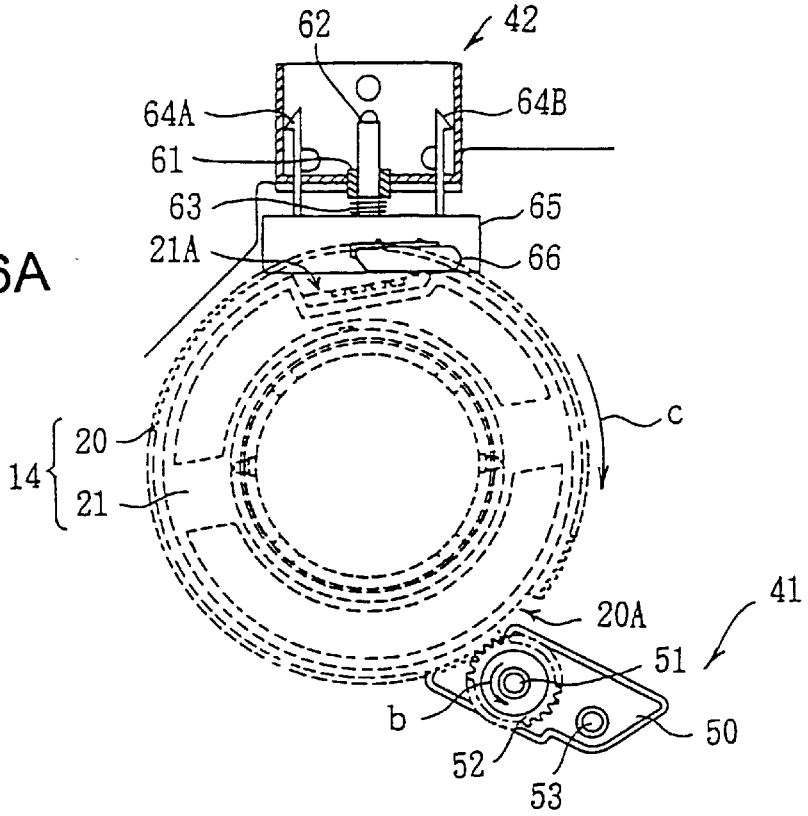
FIGS. 16(*a*) and 16(B) are front views illustrating the rotational operation of the correction ring further rotated.

When the lot correction ring 14 of the ink ribbon 10 is rotationally driven from this state by the rotational driving section 41 (FIG. 11) of the printer device 30, like the progress of the positions in FIG. 14(B), FIG. 15(*a*), FIG. 15(B) to FIG. 16(*a*), then the flat part 21A of the cylindrical part 21 of the lot correction ring 14 of the ink ribbon assembly 12 comes directly below the sensor 66 of the printer device 30 as shown in 16(B). The protuberant part 66A of the sensor 66 fits the concave part 21B of the cylindrical part 21 of the lot correction ring 14, thereby allowing individual contacts 67A to 67D of the sensor 66 to come in contact with the corresponding electrodes 23A to 23D of the memory substrate 23 of the ink ribbon assembly 10 via the respective openings 21AX1 to 21AX4 of the flat part 21A of the cylindrical part 21 of the lot correction ring 14.

In this embodiment, as evident especially from FIGS. 8(*a*), 11 and 12, a notch 20A is provided at the gear part 20 of the lot correction ring 14 so that the gear 52 (FIG. 11) of the rotational drive section 41 of the printer device 30 fits the notch 20A in a state where the protuberant part 66A of the sensor 66 fits the concave part 21B of the cylindrical part 21 of the lot correction ring 14. See FIG. 16(B).

Figure 16B:
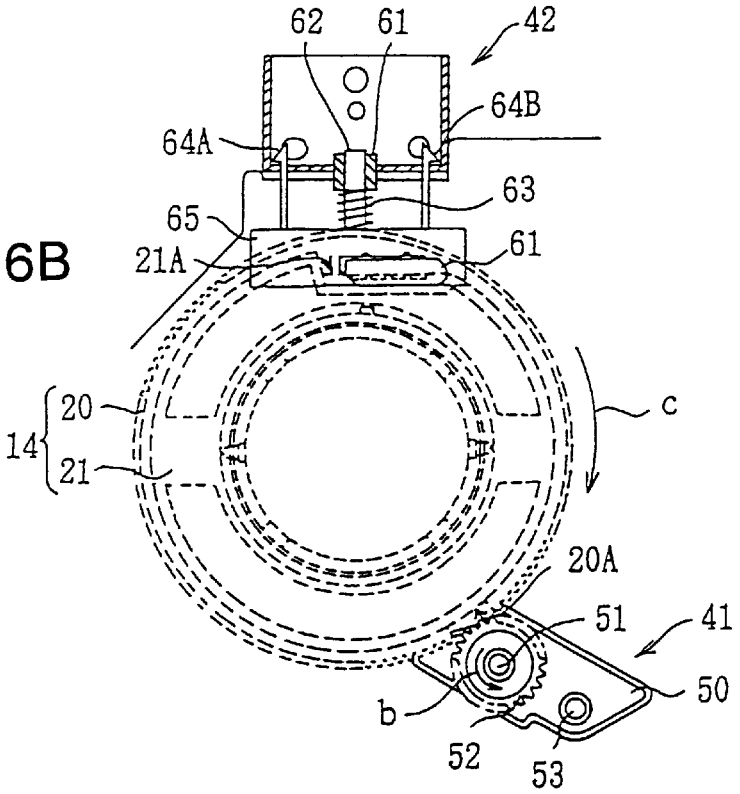

Thus, in printer 9, after lot correction ring 14 goes from the state of FIG. 14(*a*) and reaches that of FIG. 16(B), the lot correction ring 14 does not rotate under exertion of a rotational force from the rotational driving section 41 of the printer device 30, thus preventing a distortion or a breaking of individual contacts 67A to 67D of the sensor 66.

Additionally, in this embodiment, as evident especially also from FIGS. 8(*a*) to (*c*), in the cylindrical part 21 of the lot correction ring 14, a protuberant part 21C is provided on the peripheral part of the rear side of the flat part 21A which has a peripheral part of the same curvature as that of other peripheral parts of the cylindrical part.

Thus, in this print system 9, when the top cover 38 is closed after the lot correction ink ribbon assembly 10 is loaded in the ink ribbon setting section 37 of the printer device 30 in a state of being slightly rotated from the state shown in FIG. 16(B) toward the direction of the arrow c, the protuberant part 66A of the sensor 66 of the printer device 30 touches against the protuberant part 21C of the cylindrical part 21 of the lot correction ring 14, thereby preventing individual contacts 67A to 67D of the sensor 66 from coming into contact with corresponding electrodes 23A to 23D of the memory substrate 23 via the respective openings 21AX1 to 21AX4 bored in the cylindrical part 21 of the lot correction ring 14.

(3) Configuration of a Signal Processing Section

Figure 17:
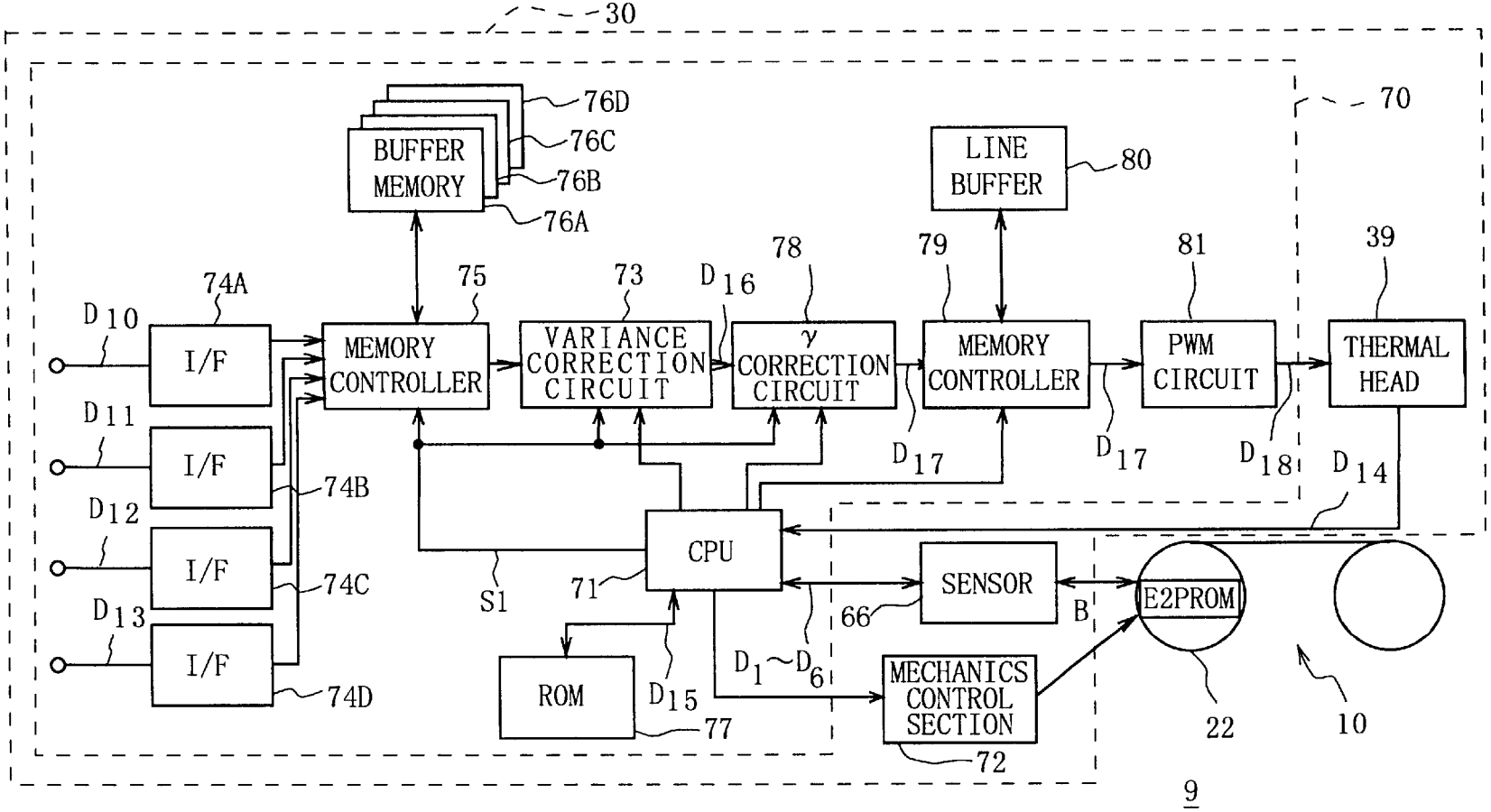
FIG. 17 is a block diagram showing the configuration of the signal processing section of the printer, according to the invention.
Figure 19A:
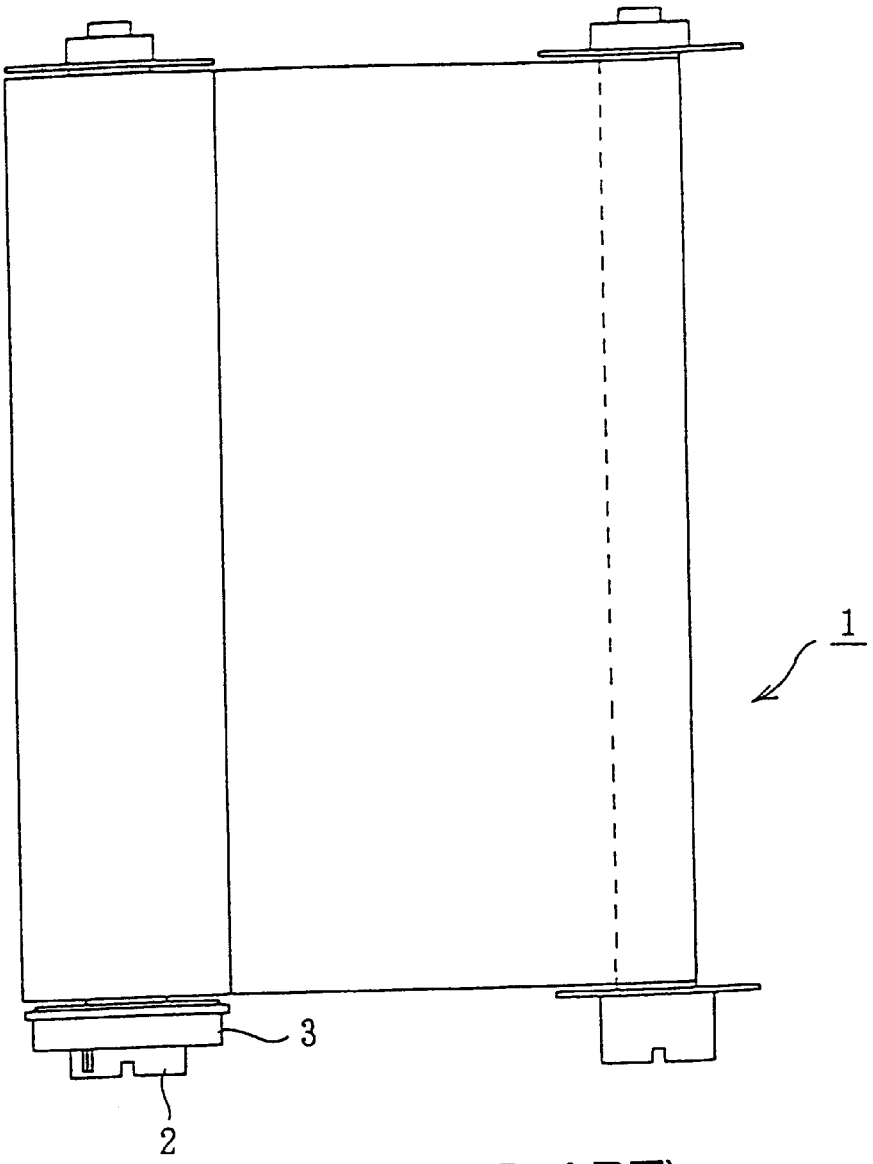
FIG. 19A (PRIOR ART)
FIG. 19(*a*) is a top view.
FIG. 19(B) is a bottom view showing a conventional ink ribbon.
Figure 19B:
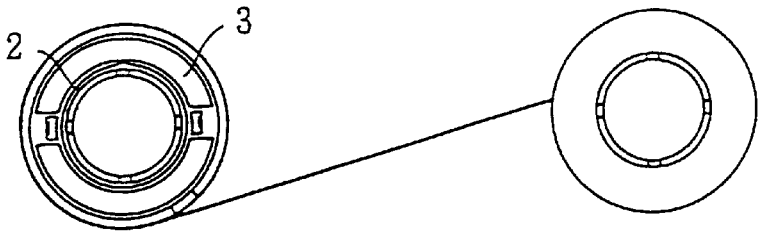
FIG. 19B (PRIOR ART)

Here, in the printer device 30, a signal processing section 70 includes a microcomputer including a CPU (Central Processing Unit) 71, as shown in FIG. 17, which is disposed inside the case 31. When the top cover 38 is closed after the ink ribbon 10 is loaded inside the case 31, the CPU 71 drives the aforementioned rotational driving section 41 (FIG. 11) via a mechanics control section 72 to rotate the lot correction ring 14 of the ink ribbon assembly 10, so that individual contacts 67A to 67D of the sensors 66 come into contact with the corresponding electrodes 23A to 23D of the memory substrate 23 in the lot correction ring 14 as shown in FIG. 16(B).

Next, the CPU 71 reads various data such as classification code data $D_1$, variance correction data $D_2$ to $D_5$ of individual ink colors and remaining amount data $D_6$ (FIG. 10) stored in the nonvolatile memory 22 of the memory substrate 23, switches the operating mode of the drive voltage application section (not shown) for applying the drive voltage to a thermal head 39 to the corresponding mode on the basis of the read classification code data $D_1$ and moreover writes the read variance correction data $D_2$ to $D_5$ into an SRAM (Static Random Access Memory—not shown) in the variance correction circuit 73.

Additionally, the "remaining amount" data $D_6$ of the ink ribbon 10 is read from the nonvolatile memory 22. If, for example, the remaining amount is less than a predetermined amount, the CPU 71 delivers a warning signal to an external instrument such as a personal computer connected to the printer device 30 to display a warning on its monitor.

During the image printing mode, the CPU 71 drives a photographic paper carrier (not shown) via the mechanics control section 72 to take out and convey a sheet of printing paper from the paper feed tray 34 (FIG. 6) loaded in the case 31 and then retains it in a predetermined state where it is pushed against a thermal head 39 via the ribbon 12 of the ink ribbon 10.

Next, when image data $D_{10}$ to $D_{13}$ for individual colors are supplied from an external instrument, for example, the CPU 71 allows them to be taken into the memory controller 75 respectively via the corresponding interface circuits 74A to 74D and to be stored respectively into the corresponding buffer memories 76A to 76D.

When image data $D_{10}$ to $D_{13}$ for individual colors are all stored in the corresponding buffer memories 76A to 76D, the CPU 71 reads out the γ correction data $D_{15}$ of the corresponding temperature for individual ink colors previously stored in the ROM (Read Only Memory) 77 on the basis of the temperature information $D_{14}$ supplied from the thermistor provided at the thermal head 39 and then writes them in the SRAM (not shown) in the γ correction circuit 78.

Next, by delivering a color select signal S1 to the memory controller 75, the CPU 71 allows the image data $D_{10}$ to $D_{13}$ for one predetermined color to be read from the corresponding buffer memories 76A to 76D for each line and to be delivered to the variance correction circuit 73.

On the basis of the color select signal S1 given from the CPU 71 at this time, the variance correction circuit 73 selects the variance correction data $D_2$ to $D_5$ of a specified color out of the variance correction data $D_2$ to $D_5$ of individual colors written in the SRAM, interpolates the variance correction data $D_2$ to $D_5$ to create data having a conversion curve as shown, e.g., in FIG. 5, and, moreover, variance-corrects the image data $D_{10}$ to $D_{13}$ successively given from the memory controller 75 on the basis of that data, and then delivers the variance correction image data $D_{16}$ to the γ correction circuit 78.

On the basis of the color select signal $S_1$ from the CPU 71, the γ correction circuit 78 selects the γ correction data $D_{15}$ of a corresponding ink color out of the γ correction data $D_{15}$ of individual colors written in the SRAM, interpolates the γ correction data $D_{15}$ to create data having a conversion curve as shown in FIG. 3 and moreover, provides γ correction on the variance correction image data $D_{16}$ on the basis of this data, and then delivers the obtained correction image data $D_{17}$ to the memory controller 79.

Then, under the control of the CPU 71, the memory controller 79 stores the correction image data $D_{17}$ to be supplied into a line buffer 80, while reading and delivering it at a predetermined timing sequence to a PWM circuit 81.

The PWM circuit 81 successively pulse-width-modulates the correction image data $D_{17}$ for one line to be supplied in succession, and then delivers the obtained image printing data $D_{18}$ to the thermal head 39 to execute the image printing for one line based on the image printing data $D_{18}$.

The CPU 71, via the mechanics control section 72, feeds the ribbon 12 of the ink ribbon 10 and a photographic paper by one line, together, and then, controls the memory controller 75, the variance correction circuit 73, the γ correction circuit 78, the memory controller 79 and the PWM circuit 81 to print predetermined lines in a manner similar to those mentioned above, thereby executing one image of color printing.

After bringing the photographic paper into fixed contact with the color ink layer coated on the ribbon 12 of the ink ribbon assembly 10 and pushing the thermal head 36 against the photographic paper via the ribbon 12, the CPU 71 executes image printing on the basis of the image data $D_{10}$ to $D_{13}$ indicative of the relevant colors in a manner similar to those mentioned above. Similar operations are repeated in sequence to print the images based on the remaining image data $D_{10}$ to $D_{13}$, with the corresponding colors.

In this way, printer device 30 is so arranged that images based upon the supplied image data $D_{10}$ to $D_{13}$ for individual colors are successively printed with the corresponding colors, so that full-colored images based on a combination of these individual colors are printed.

After the completion of one sheet of printing, the CPU 71 accesses the nonvolatile memory 22 in the ink ribbon assembly 10 via the sensor 66 to rewrite the value for the "remaining amount" data $D_6$ stored in the nonvolatile memory 22, decreased by a value of one.

Thus, in this print system 9, the "remaining amount" data $D_6$ stored in the nonvolatile memory 22 of the ink ribbon 10 is always updated to a correct value, so that the printer 30 accurately ascertains the remaining amount of the ink ribbon 12 on the basis of the "remaining amount" data $D_6$ stored in the nonvolatile memory 22.

(4) Operations and Advantages of This Embodiment

When the top cover 38 (FIG. 6) of printer is closed after the ink ribbon assembly 10 is loaded in the ink ribbon setting section 37 (FIG. 6) of the printer device 30, the rotational driving section 41 (FIG. 11) first is driven to apply a rotational force to the lot correction ring 14 of the ink ribbon assembly 10.

As a result, the lot correction ring 14 of the ink ribbon 10 rotates and then the individual contacts 67A to 67D (FIG. 13) in the sensor 66 of the printer device 30 come into contact with the corresponding electrodes 23A to 23D (FIG. 9) of the memory substrate 23 (FIG. 9) via the respective openings 21AX1 to 21AX4 (FIG. 8) of the cylindrical part 21 of the lot correction ring 14 respectively.

Next, the CPU 71(FIG. 17) reads the classification code $D_1$ of the ink ribbon assembly 10, the variance correction data $D_2$ to $D_5$ for the individual ink colors, the "remaining amount" data $D_6$ (FIG. 10) from the nonvolatile memory 22 and then stores the variance correction data $D_2$ to $D_5$ for the individual ink colors in the SRAM of the variance correction circuit 73 (FIG. 17). At this time, in accordance with the temperature information $D_{14}$ (FIG. 17) supplied from the thermistor of the thermal head 39, the CPU 71 reads the most suitable γ correction data $D_{15}$ for the temperature of the thermal head 39 at that time, concerning individual colors respectively from the ROM 77, and stores them in the SRAM of the γ correction circuit 78.

After the variance correction and the γ correction of the image data $D_{10}$ to $D_{13}$ for each color supplied from the external instrument in accordance with these variance correction data $D_2$ to $D_5$ and the γ correction data $D_{15}$, the signal processing section 70 pulse-modulates and gives the obtained correction image data $D_{17}$, one color each to the thermal head 39, to execute one color of image printing. Similarly the other individual color components of the image are printed in sequence to print the full-color image.

Since the printer device 30 automatically obtains the variance correction data $D_2$ to $D_5$ of individual colors of the loaded ink ribbon 12, a user can give the correction data (variance correction data $D_2$ to $D_5$) for correcting the production variance of individual ink colors of the ink ribbon loaded in the printer device 30 without taking the trouble of manually inputting the variance correction data $D_2$ to $D_5$ to the printer device 30 and any external instrument connected to the printer device 30.

In the print system 9, the rotational driving section 41 rotationally drives the lot correction ring 14 of the ink ribbon assembly 10 to make the respective contacts 67A to 67D of the sensor 66 come into contact with the respective electrodes 23A to 23D of the memory substrate 23, so that the user can set the ink ribbon into the printer device 30 without specifically knowing the rotational state of the lot correction ring 14 of the ink ribbon 10.

Further, in the print system 9, at the point where the respective contacts 67A to 67D of the sensor 66 of the printer device 30 come into contact with the respective electrodes 23A to 23D, the gear 51 of the rotational driving section 41 fits into the notch 20A in the gear part 20 of the lot correction ring 14 to stop the rotation of the lot correction ring 14, so that the gear 52 of the rotational driving section 41 may be left to rotate in this state. Therefore, a driving source which is used for another mechanism in the printer device 30 is also used as the driving source of the gear 52 of the rotational driving section 41, so that the printer device 30 can be easily constructed because an exclusive driving source and a special mechanism for disengaging from the lot correction ring 14 are not required.

According to the aforementioned configuration, the correction ring lot 14 is rotatably provided in the ink ribbon assembly independent of the supply spool. Moreover, the nonvolatile memory 22 is supported in the ring 14. The variance correction data $D_2$ to $D_5$ is read out from the nonvolatile memory 22 in the lot correction ring 14 of the ink ribbon 10, and then the supplied image data $D_{10}$ to $D_{13}$ is corrected based on the respective variance correction data $D_2$ to $D_5$ to perform the printing process, whereby a user can obtain printed images having color variance and density desired by the user automatically. Thus, an ink ribbon assembly and a printer device capable of distinctly promoting convenience of a user is realized.

(5) Other Embodiments

In the above embodiment, a nonvolatile memory 22 is employed as a data retention or storage means for retaining the variance correction data $D_2$ to $D_5$ for correcting the production variance of ink of individual colors in the ink ribbon assembly 10. But the present invention is not limited to this case and is applicable to other memories than nonvolatile ones, such as, for example, storage means such as magnetic disk and optical disk, a bar code label or the like. In brief, the present invention is applicable to any data retention means if it can retain the variance correction data $D_2$ to $D_5$.

If a magnetic disk or an optical disk is used as the data retention means, it would be better to attach it to the outside face of the cylindrical part 21 of the lot correction ring 14 of the ink ribbon assembly 10 and have a magnetic head or an optical pickup provided on the printer device 30 side as readout means for reading the recorded information from the magnetic or optical disk.

When bar code labels are used as the data retention means, preferably, a bar code label is affixed, for example, on the peripheral face of the cylindrical part 21 of the lot correction ring 14. An optical sensor is provided on the printer device 30 side as readout means for reading the recorded information from the bar code label.

Additionally, symbols or the like may be inscribed directly on the outside face of the cylindrical part 21 of the lot correction ring 14 or on other parts of the ink ribbon assembly 10 as data retention means or on the other hand, have an optical sensor provided on the printer device 30 side as readout means for reading this inscribed numerals, symbols or the like.

As described above, conversion data described in conjunction with FIG. 5 is employed as the variance correction data $D_2$ to $D_5$ for correcting the production variance of ink of individual colors of the ink ribbon assembly 10. But the present invention is not limited to this case and may be so arranged as to store data of a characteristic curve, for example, as indicated by "X" in FIG. 4 into the nonvolatile memory 22 of the ink ribbon assembly 10 as variation correction data used on the printer device 30 side to provide variance correction processing. In brief, other types of correction data are applicable as correction data so long as they are capable of correcting the production variance of individual ink colors of the ink ribbon.

In the description above, only 16 points of data ranging from "00" to "FF" of the conversion data of output are stored in the nonvolatile memory 22 of the ink ribbon 10, as illustrated if FIG. 5. However, the present invention is not limited to this case and may be arranged to store more or less points of data than the 16 points into the nonvolatile memory 22 of the ink ribbon assembly 10.

In the above description, a PWM circuit 81 and a thermal head 39 are employed as the printing means for printing images in accordance with the image data $D_{10}$ to $D_{13}$, subjected to the variation correction processing. The present invention is not so limited and other various arrangements may be applicable.

In the above description, the CPU 71 is arranged so as to access the nonvolatile memory 22 and rewrite the remaining amount of the ribbon 12 of the ink ribbon 10, stored in the nonvolatile memory 22, to decrease the amount by one for every completion of one line of printing. But the present invention is not limited to this case and when a plurality of sheets of image printing is continuously performed, the remaining amount data $D_6$ stored in the nonvolatile memory 22 may be arranged to be rewritten to correspond with the used amount of ribbon 12 (ink) after the completion of the relevant image printing processing.

Still further, in the above embodiment, a description was given of the case where the warning means for executing a warning, if necessary, on the basis of the remaining amount of ribbon 12 (ink) read from the nonvolatile memory 22, comprises the CPU 71 delivering a warning signal to an external instrument, when the remaining amount of ink ribbon is not greater than 5 sheets. But the present invention is not limited to this case and the warning means may comprise, for example, a CPU and a buzzer, a LCD (Liquid Crystal Display) or the like and arranged to issue a warning with light or sound in accordance with any predetermined remaining amount.

Still further, in the above embodiment, a description was given of a case where the classification code data $D_1$, the variance correction data $D_2$ to $D_5$ and the remaining amount of ribbon 12 are arranged so as to be written into the nonvolatile memory 22 of the ink ribbon assembly 10. The present invention is not limited to this case. Data such as production data or lot number of the ink ribbon 12, content of any trouble, or the like, can be arranged so as to be written therein. In such a way, it can be immediately decided on the basis of data written in the nonvolatile memory 22 of the ink ribbon 10 when the ink ribbon 10 was manufactured, what caused a problem, etc. Thus, the recording means is not limited to a readable/writable nonvolatile memory 22.

Furthermore, in the description above, the printer is described as a thermal transfer printer using a thermal head 39. But the present invention is not limited to this case. In brief, the present invention is applicable not only to a printer device for printing an image by "sticking" ink to printing paper using a thermal head 39, but also to other printer devices such as an ink jet printer device for printing a image by the ink jet technique, a printer device (image-printing device) for printing a image by using a printing plate or other various printer devices.

What is claimed is:

1. In combination, a printer device for transferring ink from an ink ribbon to a print object in accordance with supplied printing information;

an ink ribbon assembly for mounting in the printer device and including a spool, an ink ribbon having individual colors and wrapped around the spool, a lot correction ring mounted for rotation about one end of the spool, and storage means mounted on the lot correction ring for storing correction data relating to production variances of the individual ink colors of the ink ribbon;

readout means mounted in the printer device for contacting the lot correction ring for reading the correction data from the storage means of the ribbon assembly;

correction means within the printer device for correcting the supplied image information in accordance with the correction data;

print means within the printer device for printing images in accordance with the corrected print information;

wherein the storage means additionally stores, and the readout means additionally reads out, data indicative of the remaining amount of ink ribbon; and the printer device further includes write means for entering data in the storage means after each printing of an image for indicating the remaining amount of unused ink ribbon.

2. The combination as set forth in claim 1, that further includes warning means responsive to the readout means for executing a predetermined warning when there is a shortage of ink ribbon, on the basis of the remaining amount of ink ribbon data read from the data storage means.

3. A method of printing an image by transferring ink from an ink ribbon to printing objects in accordance with supplied printing information, comprising the steps of:

storing correction data relating to production variances of ink colors in an ink ribbon in a storage device associated with an ink ribbon support structure;

reading the stored correction data at a printer;

correcting the supplied printing information at the printer in accordance with the correction data; and printing an image with the printer in accordance with corrected print information.

4. A print method as set forth in claim 3 including the additional steps of storing quantity data indicative of the remaining amount of ink ribbon; and rewriting the quantity data in the storage device after each printing indicating the new remaining amount of ribbon.

5. A printer device for transferring ink from an ink ribbon to a print object to create an image in accordance with supplied printing information, comprising:

a printer;

an ink ribbon assembly including a spool, a lot correction ring mounted to rotate about one end of the spool, an ink ribbon having a plurality of colors, and a plurality of storage means mounted on the lot correction ring for individually storing digital variance correction data of individual colors of ink in the ribbon, wherein the lot correction ring includes a gear for turning the lot correction ring about the spool and a first set of electrical contacts individually connected to the storage means;

readout means mounted within the printer and including a second set of electrical contacts for reading the digital variance correction data from the storage means of the ribbon assembly by rotating the gear until the first series of contacts mates with the second series of contacts; and processing means connected to the readout means for modifying the supplied printing information in accordance with the digital variance correction data and creating an image accordingly.

6. A printer device as set forth in claim 5, wherein the digital variance correction data includes correction data for the correction of production variances in ink ribbon characteristics; and wherein the processing means modifies the supplied printing information in accordance with the correction data.

7. A printer device as set forth in claim 6, wherein the storage means comprise a nonvolatile memory in which data indicative of the remaining amount of said ribbon is stored.

8. A printer device as set forth in claim 7, wherein the processing means additionally includes rewrite means for entering data in the nonvolatile memory indicating the amount of unused ink ribbon after each image is printed.

9. A printer device as set forth in claim 8, wherein said processing means executes a predetermined warning, if necessary, on the basis of the data indicative of the remaining amount of ink read from the storage means.

10. A printer device as set forth in claim 5, including a video monitor which displays a color image to be printed, and wherein the digital variance correction data includes gamma correction data to produce a printed image which corresponds in color to that displayed on the monitor.

11. A printer device as set forth in claim 5, wherein the digital variance correction data also includes data indicating the type of ink in the ink ribbon.

12. A method of printing an image by transferring ink from an ink ribbon to printing objects in accordance with supplied printing information, comprising:

storing digital variance correction data indicative of ink ribbon characteristics in a storage device associated with an ink ribbon support structure;

reading the digital variance correction data from the storage device;

modifying the supplied printing information in accordance with the digital variance correction data; and printing an image in accordance with the modified supplied printing information.

13. A print method as set forth in claim 12, including the further step of modifying the supplied printing information in accordance with digital variance correction data comprising data indicating production variances for the particular ink ribbon.

14. A print method as set forth in claim 12, including the additional steps of storing data as to the remaining amount of unused ink ribbon; and rewriting the quantity data in the quantity data in the storage device after printing of the new amount of unused ink ribbon.

15. A print method as set forth in claim 12, including the additional steps of storing data in the storage device as to the type of ink in the ink ribbon.

16. A print method as set forth in claim 12, including the additional step of storing gamma correction data in the storage device to correct the colors of printed images to correspond with those displayed on a video monitor.

* * * * *